United States Patent [19]

Fujishiro et al.

[11] 4,100,854

[45] Jul. 18, 1978

[54] DEVICE FOR MOUNTING RESIN PLATE ONTO PLATE CYLINDER

[75] Inventors: Yuji Fujishiro; Hideo Ohta, both of Tokyo, Japan

[73] Assignee: Japan Society for Promotion of Machine Industry, Tokyo, Japan

[21] Appl. No.: 501,466

[22] Filed: Aug. 28, 1974

[30] Foreign Application Priority Data

[JP] Japan .....

[51] Int. Cl.[2] ..... B41F 27/06

[52] U.S. Cl. ..... 101/415.1; 101/378

[58] Field of Search ..... 101/415.1

[56] References Cited

U.S. PATENT DOCUMENTS

| | | | |
|---|---|---|---|
| 629,916 | 8/1899 | North | 101/415.1 |
| 1,275,877 | 8/1918 | Drange | 101/415.1 |
| 1,345,300 | 6/1920 | White | 101/415.1 |
| 2,453,927 | 11/1948 | Morse | 101/415.1 |
| 2,857,841 | 10/1958 | Worthington et al. | 101/415.1 X |
| 3,191,532 | 6/1965 | Hermach et al. | 101/415.1 |
| 3,276,365 | 10/1966 | Langer | 101/415.1 |
| 3,335,663 | 8/1967 | Harenza | 101/415.1 |
| 3,359,899 | 12/1967 | Zuehrs | 101/415.1 |
| 3,408,933 | 11/1968 | Hermach et al. | 101/415.1 |
| 3,605,621 | 9/1971 | Woessner et al. | 101/415.1 |
| 3,625,151 | 12/1971 | Hart | 101/415.1 |
| 3,659,525 | 5/1972 | Woessner et al. | 101/415.1 |
| 3,750,572 | 8/1973 | Etchell et al. | 101/415.1 |
| 3,752,075 | 8/1973 | Fusco | 101/415.1 |
| 3,824,928 | 7/1974 | Langer | 101/415.1 |

*Primary Examiner*—Louis G. Mancene
*Assistant Examiner*—Paul J. Hirsch
*Attorney, Agent, or Firm*—Armstrong, Nikaido, Marmelstein & Kubovcik

[57] ABSTRACT

A device for mounting a plastic film based resin plate for use in printing on a plate cylinder has a groove formed along one longitudinal side edge of each of two members having a symmetrical semicircular section and constituting a plate cylinder, each of said two members consisting of a plate cylinder proper and a plate cylinder outer ring, a fixing member made of a resilient material and having a wedge-shaped protrusion adapted to fit into said groove, said fixing member being fixedly secured to a freely rotatable support shaft which is mounted at a position adjacent to groove and is connected through a linkage to a first operating rod. The device further comprises a support shaft mounted at a position adjacent to the other longitudinal side edge of each of said two members, said support shaft having fitted thereon and fixedly secured thereto a tension member formed with a groove and a holding member having formed thereon a protrusion adapted to fit into said groove, another support shaft adapted to be rotated by means of an operating rod, and a cam for operating the tension member and a cam for operating the holding member fixedly secured to said another shaft. These cams are arranged in such an angular relationship that the tension member is kept away from the holding member when the operating rod is located at an open position, and the protrusion of the holding member is fitted into the groove of the tension member when the operating rod is located at a locking position, and further the tension member and the holding member are rotated together away from said other longitudinal side edge while the protrusion remains fitted into the groove when the operating rod is rotated from the locking position to a tensioning position.

1 Claim, 6 Drawing Figures

DEVICE FOR MOUNTING RESIN PLATE ONTO PLATE CYLINDER

This invention relates to a device for mounting a resin plate for use in printing, in particular to a device for mounting a plastic film based resin plate for printing on a plate cylinder.

The plastic film based resin plate comprises for its basic material a thin non-metallic plastic film, and therefore it cannot be mounted on a plate cylinder by the known method applicable for mounting a metallic base plate to a plate cylinder. For this reason, the plastic film based resin plate has heretofore been mounted to a plate cylinder by two methods, i.e., one of which is to allow the resin plate to adhere to the plate cylinder with an adhesive agent applied to the back surface of the former and the other of which is to fixedly secure metal fittings for mounting on both ends of the resin plate thereby mounting the latter to the plate cylinder by the rigidity of the metal fittings.

However, the former method has a disadvantage in that an adhesive agent is necessary as an article of consumption and a substantial labour is required for applying the adhesive agent on the resin plate, while the latter method is disadvantageous in that metal fittings are necessary as an article of consumption and a substantial labour is required for securing the metal fittings to the resin plate.

The present invention has been devised in the light of the above-mentioned circumstances, and has for its object to provide a device for mounting a plastic film based resin plate on a plate cylinder whereby the resin plate can be fitted to the latter without any substantial labour and additional means.

The present invention will now be described, by way of example only, with reference to the accompanying drawings illustrating one embodiment thereof, in which.

Figure 4A:
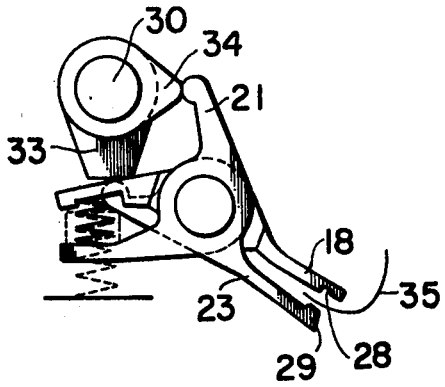
Figure 4B:
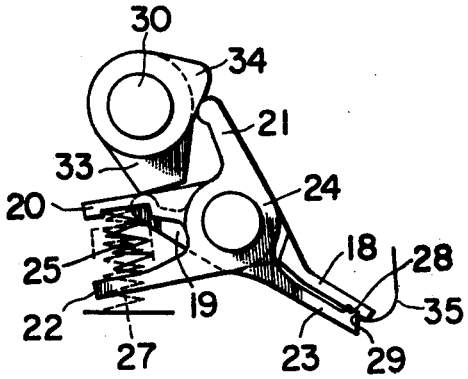
Figure 4C:
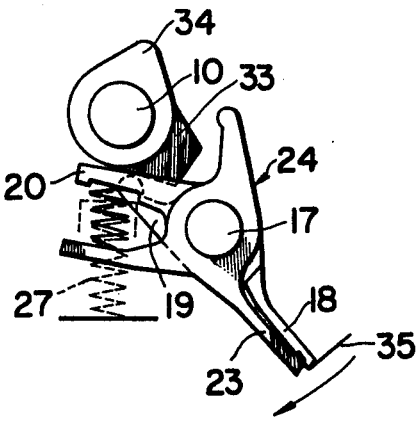

FIG. 4 (*a*), (*b*) and (*c*) are diagrammatic views for explaining a mechanism for holding and applying a tension to a resin plate respectively.

Reference numeral 1 represents a plate cylinder proper consisting of two members, each having a symmetrical semi-circular section. On the outer peripheral surface of each cylinder proper 1 is mounted a plate cylinder outer ring 2, to which a tension is applied.

Along one longitudinal side edge 3 of each plate cylinder outer ring 2, there is formed a rectangular-shaped or U-shaped groove 4 in the longitudinal direction.

Reference numeral 5 denotes a mechanism mounted at a position adjacent to the above-mentioned groove 4 for fixedly securing a resin plate. Reference numeral 6 represents a mechanism for holding and applying a tension to a resin plate, and the mechanism being mounted adjacent to the other longitudinal side edge 7 of each plate cylinder outer ring 2.

Figure 1:
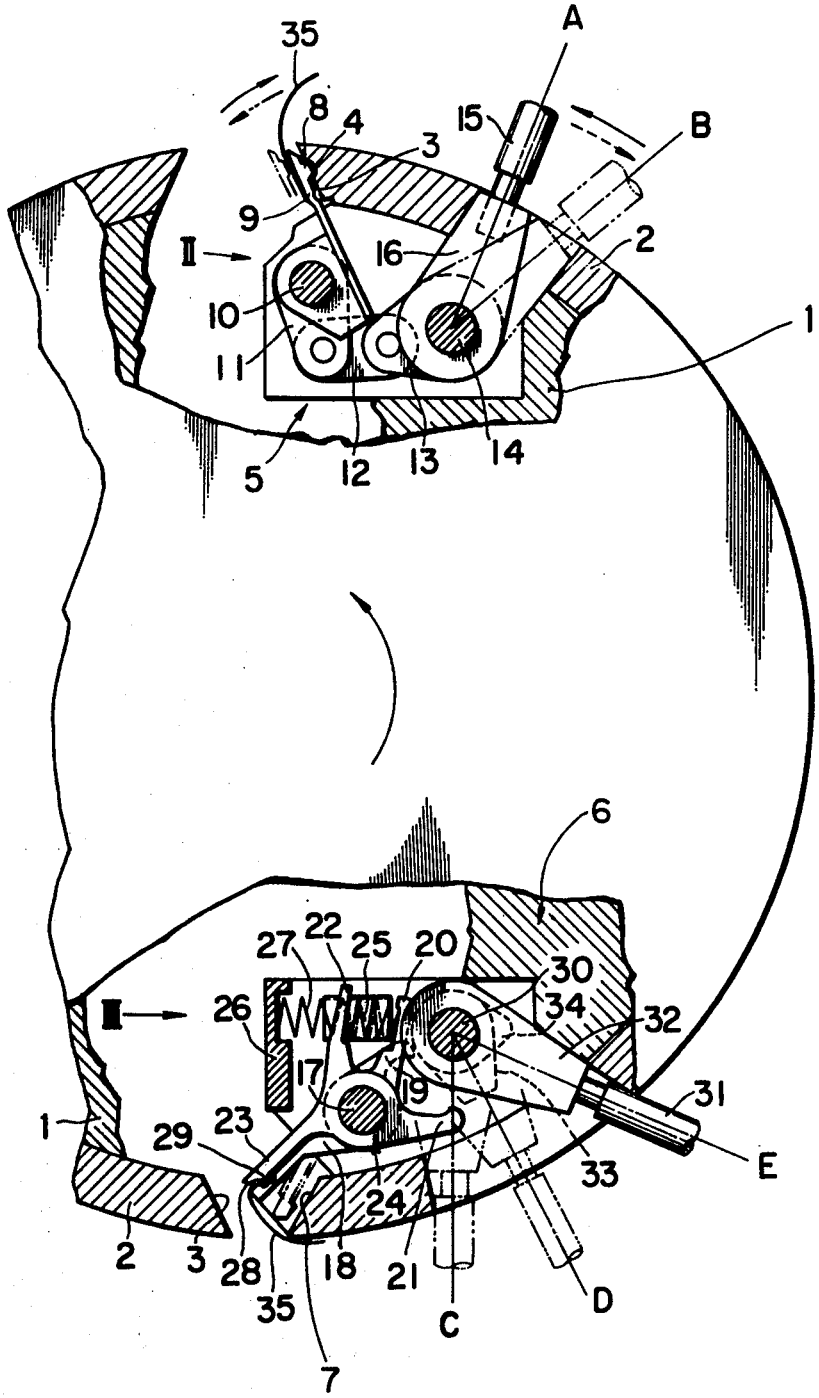
FIG. 1 is a front view of the device according to the present invention.
Figure 2:
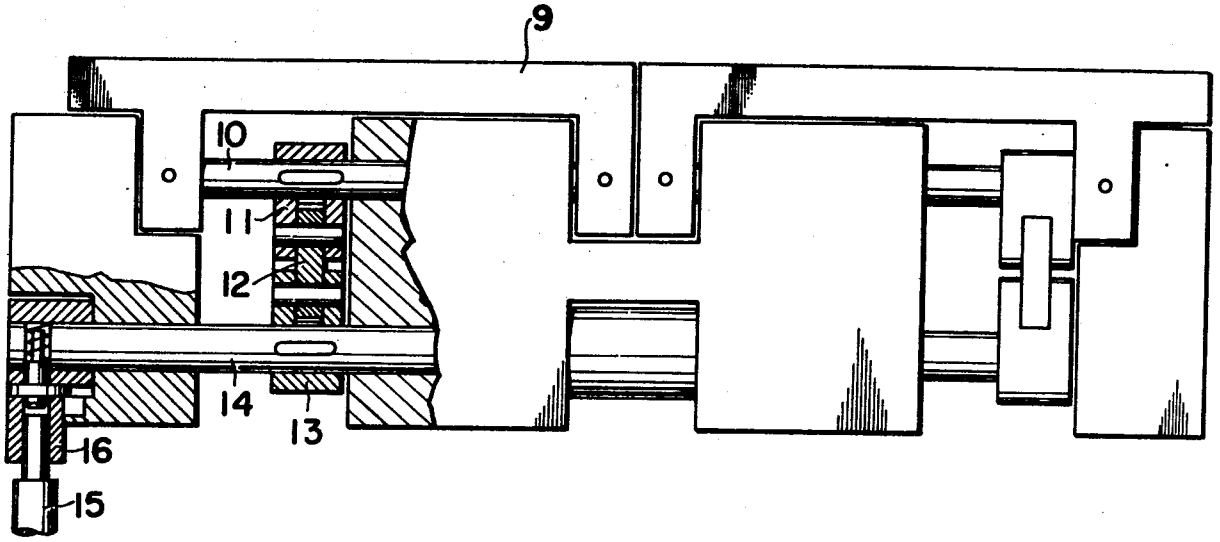
FIG. 2 is a partly broken view taken in the direction II of FIG. 1.

The above-mentioned resin plate fixing mechanism 5 is constructed as shown in FIGS. 1 and 2. Stating more specifically, the resin plate fixing mechanism comprises a fixing member 9 made of a resilient material such as plate spring etc. and having formed thereon a wedge-shaped protrusion 8 adapted to fit into the groove 4, said fixing member being fixedly secured to a support shaft 10 which is connected through an arm 11, a link 12 and an arm 13 to a support shaft 14, said shaft 14 having secured thereto a member 16 for attaching an operating rod 15 thereto. In use, when the operating rod is rotated to a locking position A, the fixing member 9 is moved so as to allow the protrusion 8 thereof to fit into the groove 4. When the operating rod 15 is rotated to an unlocking or open position B, the fixing member 9 is moved in the opposite direction so as to disengage the protrusion 8 thereof from the groove 4.

Figure 3:
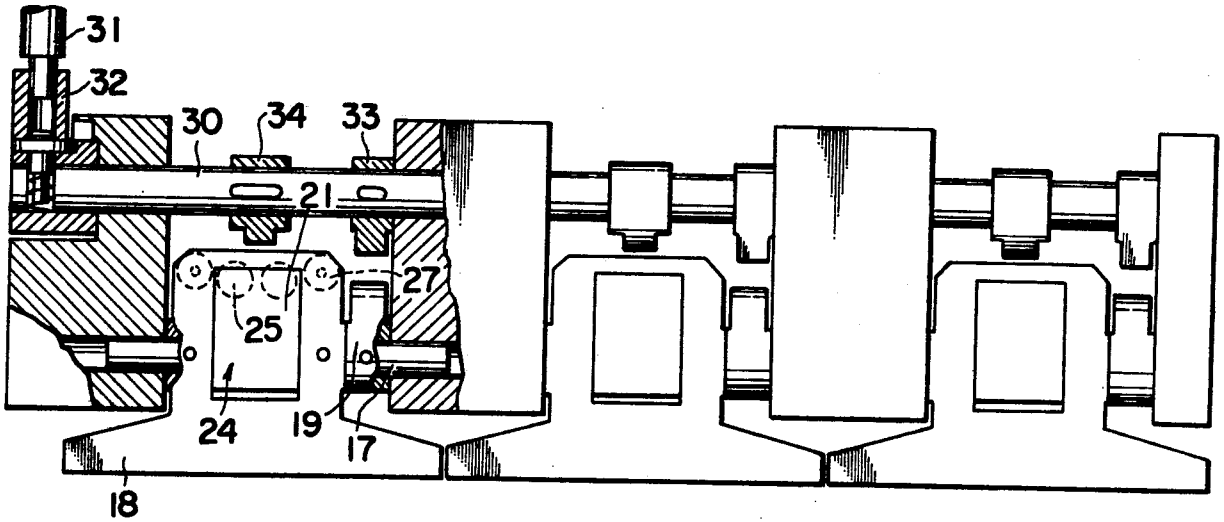
FIG. 3 is a partly broken view taken in the direction III of FIG. 2.

The above-mentioned resin plate holding and tensioning mechanism 6 has such a construction as shown in FIGS. 1 and 3. The mechanism 6 comprises a support shaft 17 having fitted thereon and fixedly secured thereto a tension member 18, a first cam guide 19 and a first spring bearing 20, said support shaft 17 having fitted thereon and fixedly secured thereto a freely rotatable three-forked member 24 comprising a second cam guide 21, a second spring bearing 22 and a holding member 23 which is disposed opposite to said tension member 18, a first spring 25 loaded between said first spring bearing 20 and said second spring bearing 22, and a second spring 27 loaded between said first spring bearing 20 and a fixing member 26. Further, the tension member 18 is formed with a groove 28, and the holding member 23 is formed with a wedge-shaped protrusion 29 adapted to fit into or engage with the groove 28. Reference numeral 30 represents a support shaft having fixedly secured thereto a member 32 for attaching an operating rod 31 thereto, said support shaft having fitted thereon and fixedly secured thereto a first cam 33 adapted to be brought into contact or engage with the first cam guide 19, and a second cam 34 adapted to be brought into contact with the second cam guide 21.

The operation of this device will now be described below.

(1) One side edge of the resin plate 35 is placed between one longitudinal side edge 3 of the plate cylinder outer ring 2 and the fixing member 9.

(2) The operating rod 15 is then rotated towards the locking position A thereby rotating the support shaft 14 in anticlockwise direction, so that the support shaft 10 is rotated through the arm 13, the link 12 and the arm 11 in clockwise direction. As a result, the fixing member 9 is moved so as to allow the wedge-shaped protrusion 8 thereof to fit into the groove 4, so that the protrusion 8 forces or locks up one side edge of the resin plate into the groove 4.

(3) Then, the operating rod 15 is rotated further towards the locking position A thereby rotating the support shaft 10 further in clockwise direction, so that one edge of the resin plate is firmly locked or clamped between the wedge-shaped protrusion 8 of the fixing member 9 and the groove 4 by the resilient force of the fixing member itself. On the other hand, when the operating rod is rotated towards the unlocking or open position B, the fixing member 9 will move in the opposite direction, so that the clamping force exerted on the resin plate is released.

(4) The other side edge of the resin plate 35 is placed between the tension member 18 and the holding member 23 as shown in FIG. 4*a*.

(5) The operating rod 31 is then rotated from the unlocking or open position C to the locking position D, thereby rotating the support shaft 30 in anticlockwise direction. As a result, the second cam 34 is disengaged from the second cam guide 21 as shown in FIG. 4*b*, so that the second spring bearing 22 of the three-forked rotatable member 24 is rotated by the first spring 25 in anticlockwise direction so as to allow the holding member 23 to move towards the tension member 18 and clamp the other side edge of the resin plate by the cooperation of the groove 28 of the tension member and the wedge-shaped protrusion 29 of the holding member. At the time, the first cam 33 comes into contact with the first cam guide 19 so that the tension member 18 is fixed in the position as shown in FIG. 4*b*.

(6) And then, the operating rod 31 is rotated from the locking position D towards the tensioning position E, thereby rotating the support shaft 30 further in anticlockwise direction. As a result the first cam 3 is disengaged from the first cam guide 19, so that the first spring bearing 20 is rotated by the second spring 27 in clockwise direction so as to rotate the support shaft 17 with the tension member 18 and apply a tension to the resin plate 35 and keep it in tightly engaged relationship with the outer surface of the plate cylinder outer ring 2.

In the above-mentioned embodiment of the present invention, there is described a plate cylinder which consists of a plate cylinder proper 1 and a separate plate cylinder outer ring 2 mounted thereon. However, it is of course possible to construct the plate cylinder proper 1 and the plate cylinder outer ring 2 in an integral unit.

The present invention is so constructed as being described hereinbefore, so that it is possible to mount a plastic film based resin plate on a plate cylinder in a simple operation without processing or working the resin plate. Furthermore, for the operation of the device it is only necessary to rotate the two operating rods 15 and 31, and therefore the operation for mounting the resin plate to the plate cylinder becomes extremely simple.

What is claimed is:

1. A device for mounting a plastic film based resin plate for use in printing on a plate cylinder, characterized in that said device comprises a first groove formed along one longitudinal side edge of each of two members having a symmetrical semi-circular section which constitute a plate cylinder, and each consisting of a plate cylinder proper and a plate cylinder outer ring, a fixing member made of a resilient material and having formed thereon a first wedge-shaped protrusion adapted to fit into the groove, with said fixing member being fixedly secured to a freely rotatable first support shaft, said first support shaft being mounted at a position adjacent to the first groove and connected through linkage composed of a first arm, a link and a second arm connected to a first operating rod, a second support shaft mounted at a position adjacent to the other longitudinal side edge of each of said two members, said second support shaft having fitted thereon and fixedly secured thereto a tension member formed with a second groove and a holding member having formed thereon a second protrusion adapted to fit into the second groove, a third support shaft adapted to be rotated by operating a second operating rod, and a cam for operating the tension member and a cam for operating the holding member fixedly secured to the third support shaft, said cams being arranged in an angular relationship so that the tension member is kept away from the holding member when the first operating rod is located at an unlocked or open position, and the first wedge-shaped protrusion of the holding member fits into the second groove of the tension member when the second operating rod is located at a locking position, and further the tension member and the holding member are rotated together away from said other longitudinal side edge while the first wedge-shaped protrusion remains fitted into the groove, when the second operating rod is rotated from the locking position to a tensioning position.

* * * * *